US008365917B2

(12) United States Patent
Olesen

(10) Patent No.: US 8,365,917 B2
(45) Date of Patent: Feb. 5, 2013

(54) CARRIER TRAY, BLANK THEREFOR AND ASSOCIATED METHODS

(76) Inventor: Adam Olesen, North Sydney (AU)

( * ) Notice: Subject to any disclaimer, the term of this patent is extended or adjusted under 35 U.S.C. 154(b) by 483 days.

(21) Appl. No.: 12/745,171

(22) PCT Filed: Nov. 29, 2007

(86) PCT No.: PCT/AU2007/001829

§ 371 (c)(1),
(2), (4) Date: Aug. 11, 2010

(87) PCT Pub. No.: WO2008/064414

PCT Pub. Date: Jun. 5, 2008

(65) Prior Publication Data

US 2010/0320114 A1 Dec. 23, 2010

(30) Foreign Application Priority Data

Dec. 1, 2006 (AU) ..... 2006906711

(51) Int. Cl.
*B65D 71/00* (2006.01)
*B65D 75/00* (2006.01)

(52) U.S. Cl. ..... 206/549; 206/167; 206/170; 206/180; 206/187; 206/198

(58) Field of Classification Search ..... 206/141, 206/167, 170–175, 180, 182–189, 192, 194, 206/197, 198, 428, 549; 53/48.6, 48.8, 48.9; 493/51, 121, 137, 162, 138, 226
See application file for complete search history.

(56) References Cited

U.S. PATENT DOCUMENTS

| | | | | |
|---|---|---|---|---|
| 2,701,661 | A * | 2/1955 | Murray | 206/154 |
| 3,773,214 | A * | 11/1973 | Lemon | 206/194 |
| 3,780,906 | A * | 12/1973 | Katzenmeyer | 206/170 |
| 4,049,116 | A * | 9/1977 | Cope | 206/176 |
| 4,146,168 | A * | 3/1979 | Hartline | 206/194 |
| 5,052,552 | A * | 10/1991 | Maroszek | 206/174 |
| 5,743,389 | A | 4/1998 | Cutler et al. | |
| 5,803,264 | A * | 9/1998 | Gersten et al. | 206/549 |
| 6,202,836 | B1 * | 3/2001 | Picciolo | 206/194 |
| 2003/0106828 | A1 * | 6/2003 | Hunter | 206/549 |
| 2003/0209454 | A1 | 11/2003 | Hunter | |
| 2008/0217191 | A1 * | 9/2008 | Bates et al. | 206/194 |

FOREIGN PATENT DOCUMENTS

WO 2004067393 A 8/2004

OTHER PUBLICATIONS

International Search Report & Written Opinion mailed Jan. 10, 2008 of PCT/AU2007/001829 filed Nov. 29, 2007 (6 pages).

* cited by examiner

*Primary Examiner* — Luan K Bui
(74) *Attorney, Agent, or Firm* — Pillsbury Winthrop Shaw Pittman LLP

(57) ABSTRACT

A carrier tray (1) for beverage cups, bottles, and consumables or edible products is disclosed which is able to be folded from a blank (11). The tray has a base (2, 3) an upper deck (5), side walls (12, 13), a handle (15) and container receiving apertures (6-9). The blank is able to be fabricated from a single sheet of cardboard without gluing and folded to form the carrier tray. Braces (32, 33) which fold out from the handle strengthen the tray. Unbalanced loads are able to be supported by the tray.

8 Claims, 8 Drawing Sheets

CARRIER TRAY, BLANK THEREFOR AND ASSOCIATED METHODS

CROSS-REFERENCE TO RELATED APPLICATIONS

This is the U.S. National Stage of PCT/AU2007/001829 filed Nov. 29, 2007, and relates to Australian Application No. 2006906711, filed Dec. 1, 2006, the entire contents of both applications are incorporated herein by reference in their entireties.

FIELD OF THE INVENTION

The present invention relates to a carrier tray for cups, beverage bottles and like containers for liquids. The present invention also relates to a blank from which the tray can be folded and associated methods.

Such carrier trays are widely used to enable patrons to take away coffee or alcoholic beverages from cafes, liquor outlets at sporting stadia, and the like. Such carrier trays are either given away free or sold for a nominal price and so must be relatively inexpensive to manufacture. One class of carrier trays are those moulded from either plastics material or cellulose pulp. The other class of carrier tray are those folded from planar sheet material, (typically cardboard) and the present invention is particularly concerned with this class of carrier tray.

BACKGROUND ART

In order to reduce costs in fabricating such a carrier tray, it is highly desirable to enable the entire tray to be folded from a single blank formed from a single sheet of planar material such as cardboard. In particular, it is desirable to avoid steps such as gluing which are required to attach two or more pieces of cardboard together to fabricate some arrangements.

GENESIS OF THE INVENTION

The genesis of the present invention is a desire to produce a carrier tray from such a blank, to produce the blank, and to provide the methods of folding to enable the carrier tray to be folded from the blank and for the blank to be re-configured between transport and assembly configurations.

SUMMARY OF THE INVENTION

In accordance with the first aspect of the present invention there is disclosed a carrier tray for cups, beverage bottles, and like containers for liquids, said tray being folded from a substantially planar blank and comprising a base, an upper deck spaced from said base and including at least one container receiving aperture, side walls extending between said base and upper deck, and a carrying handle extending above said upper deck.

In accordance with the second aspect of the present invention there is disclosed a planar blank for a carrier tray for cups, beverage bottles and like containers for liquids, said blank comprising:

(i) a rectangular centrally located upper deck portion including at least one container receiving aperture and a handle receiving slot, (ii) a pair of side walls located one to either side of said upper deck portion, and foldable relative thereto, (iii) a pair of base portions located one adjacent to a corresponding one of said side walls, and foldable relative thereto, and (iv) a pair of handle portions located one adjacent to a corresponding one of said base portions, and foldable relative thereto, whereby said blank extending from one extremity to the opposite extremity comprises, in order, handle portion, base portion, side wall, upper deck portion, side wall, base portion and handle portion.

In accordance with the third aspect of the present invention there is disclosed a method of folding the abovementioned planar blank to form the abovementioned carrier tray, said method comprising the steps of:

(i) folding each of said handle portions to be substantially perpendicular to the adjacent base portion, (ii) folding each of said base portions to be substantially perpendicular to the adjacent side wall, (iii) folding each of said side walls to be substantially perpendicular to the upper deck portion whilst inserting both said handle portions into, and through, said handle receiving slot until said base portions are substantially parallel to said upper deck.

In accordance with the fourth aspect of the present invention there is disclosed a method of folding the abovementioned planar blank into a folded transport configuration, the method comprising the steps of:

(i) folding each said handle portion to like substantially parallel to, and substantially abut, the adjacent base portion, and (ii) folding said upper deck portion about said handle receiving slot to substantially abut said folded handle portions.

In accordance with the fifth aspect of the present invention there is disclosed a method of unfolding the abovementioned planar blank from a folded transport configuration to a planar assembly configuration, said method comprising the steps of reversing steps (ii) and (i) above, in that order.

BRIEF DESCRIPTION OF THE DRAWINGS

A preferred embodiment of the present invention will now be described with reference to the accompanying drawings in which.

DETAILED DESCRIPTION

Figure 1:
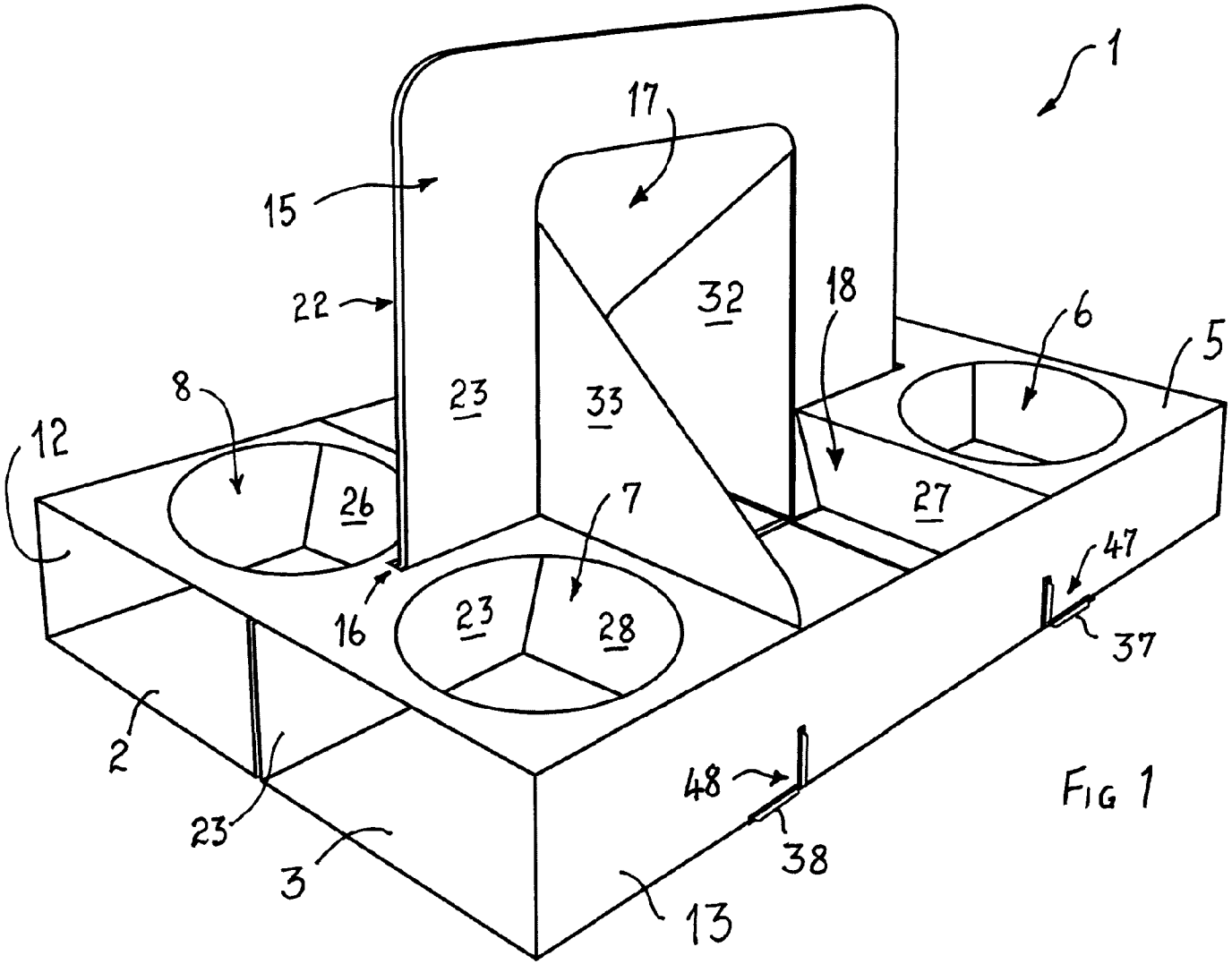
FIG. 1 is a perspective view of the assembled carrier tray of the preferred embodiment, the fingers of the container receiving apertures being omitted to show interior details of the tray.
Figure 2:
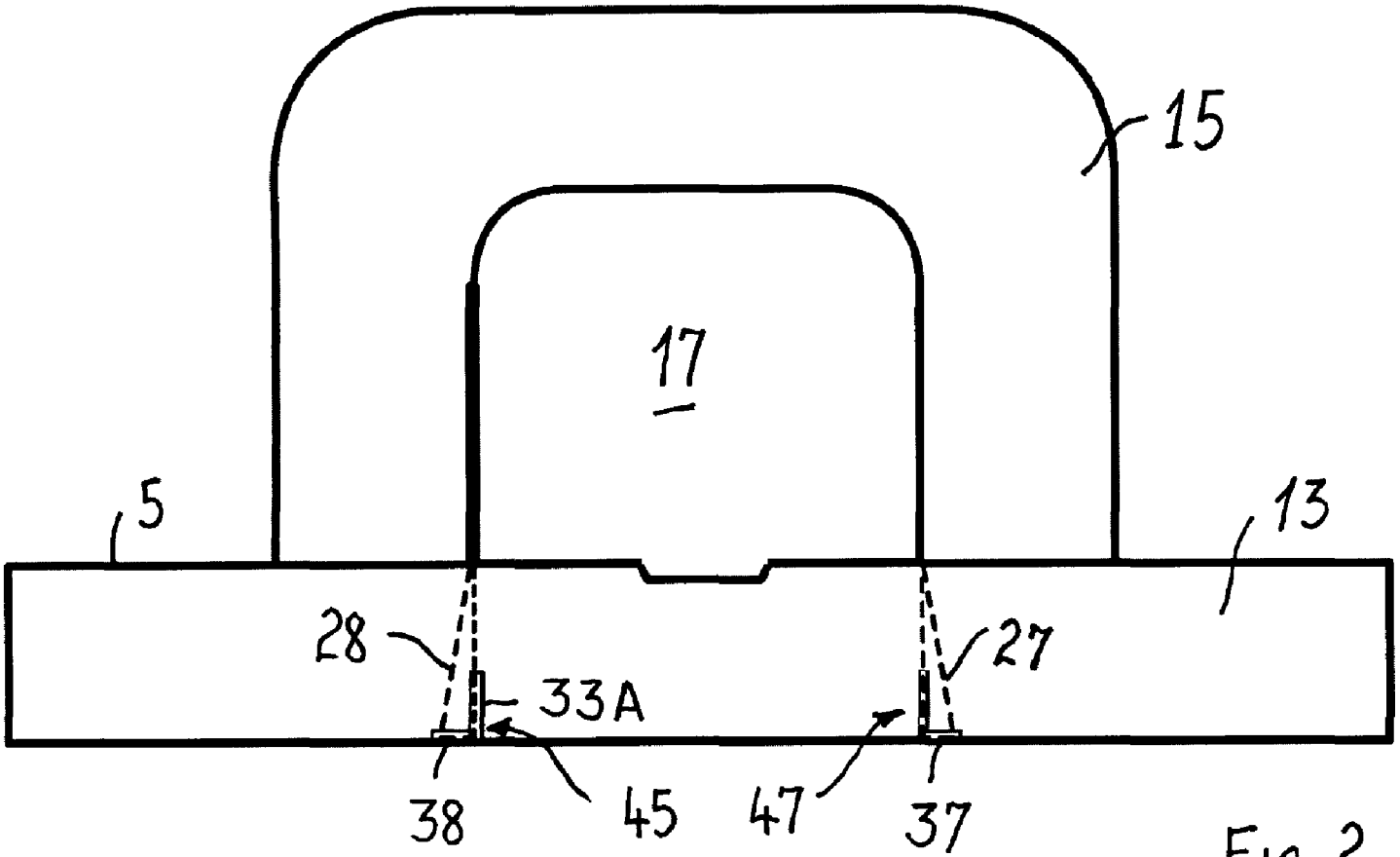
FIG. 2 is a side elevation of the tray of FIG. 1.
Figure 3:
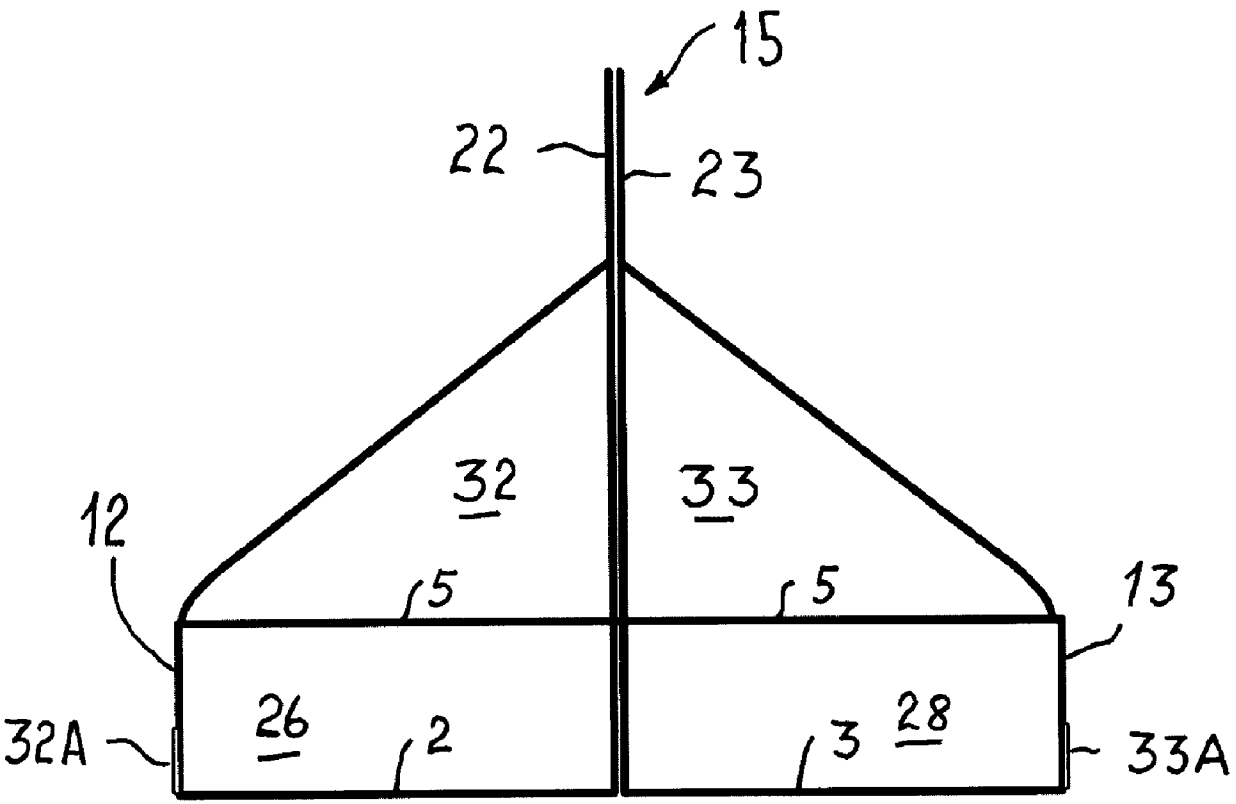
FIG. 3 is an end elevation of the tray of FIG. 1.
Figure 4:
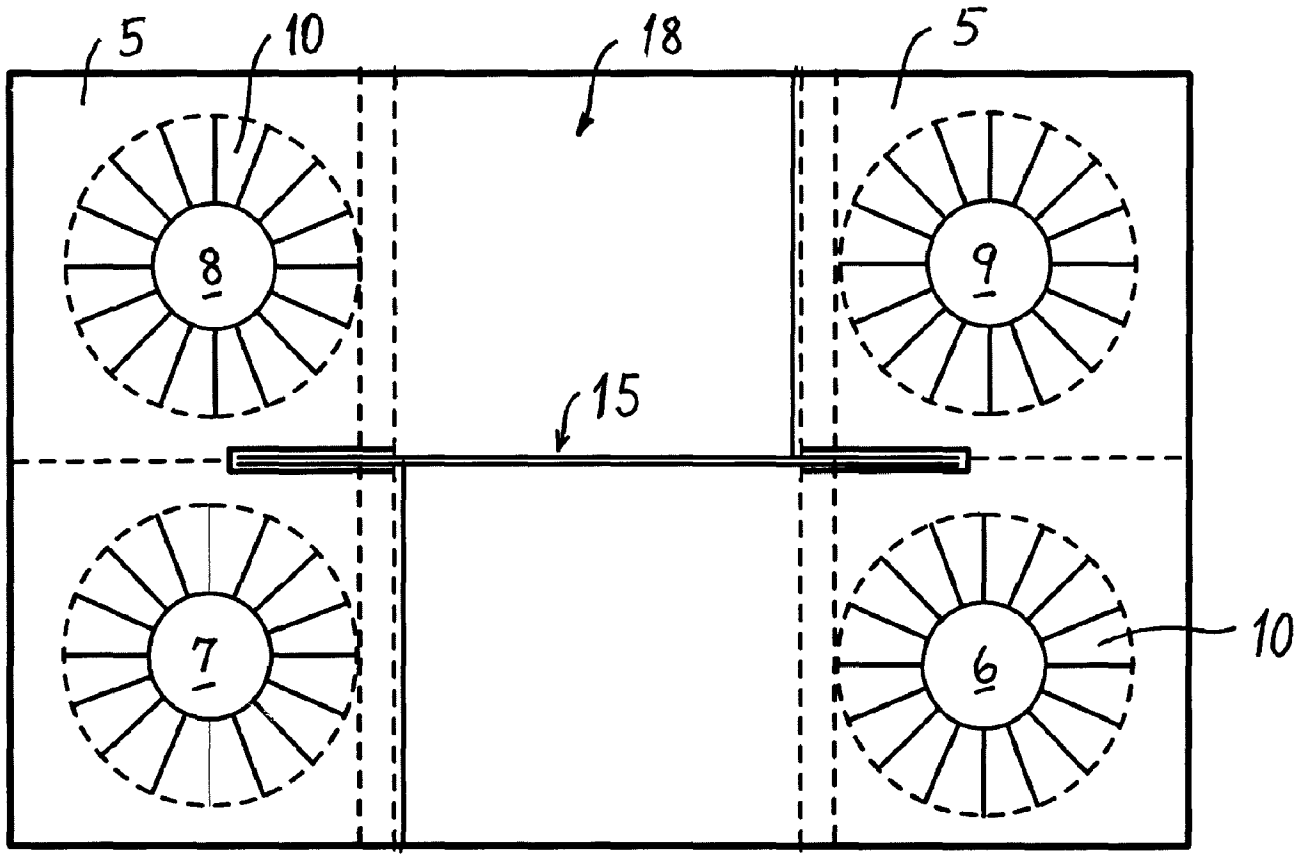
FIG. 4 is a plan view of the tray of FIG. 1.
Figure 5:
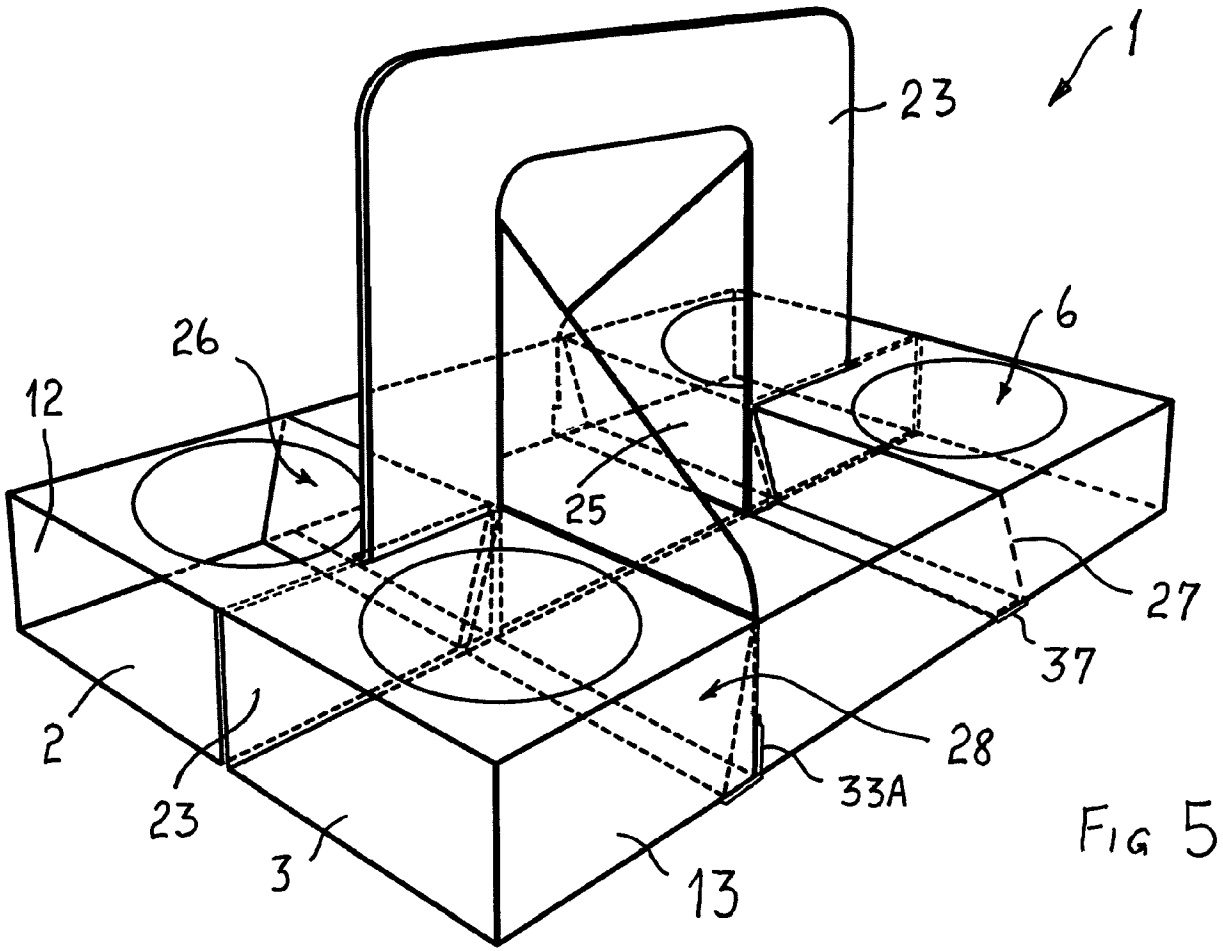
FIG. 5 is another perspective view of the tray of FIG. 1 but showing by means of dotted lines the interior arrangement.

As seen in FIGS. 1-5, the assembled carrier tray 1 has two base portions 2, 3, and an upper deck 5 which has four container receiving apertures 6-9. As seen in FIG. 4, each of the container receiving apertures 6-9 has a multiplicity of radially extending fingers 10 (omitted from FIG. 1) which permit cups, beverage bottles, and like containers for liquids of a range of diameters to be received within the apertures 6-9.

Extending between the base portions 2, 3 and the upper deck 5 are respective side walls 12, 13. A carrying handle 15 is provided and is formed from two like generally U-shaped handle portions 22, 23 which extend upwardly from the base portions 2, 3 respectively through a handle receiving slot 16. In addition, each handle portion 22, 23 has a corresponding quasi-triangular brace 32, 33 which swings outwardly from the corresponding handle portion into a central opening 18 in the upper deck 5. This movement of the braces 32, 33 enlarges a finger receiving opening 17 in the carrying handle 15.

The central opening 18 is provided with four fold down walls 25-28 each of which has a Z-shaped configuration and each of which has a latching tongue 35-38 which is retained in the base of a corresponding L-shaped slot 45-48 in the side walls 12, 13.

Figures 6, 7:
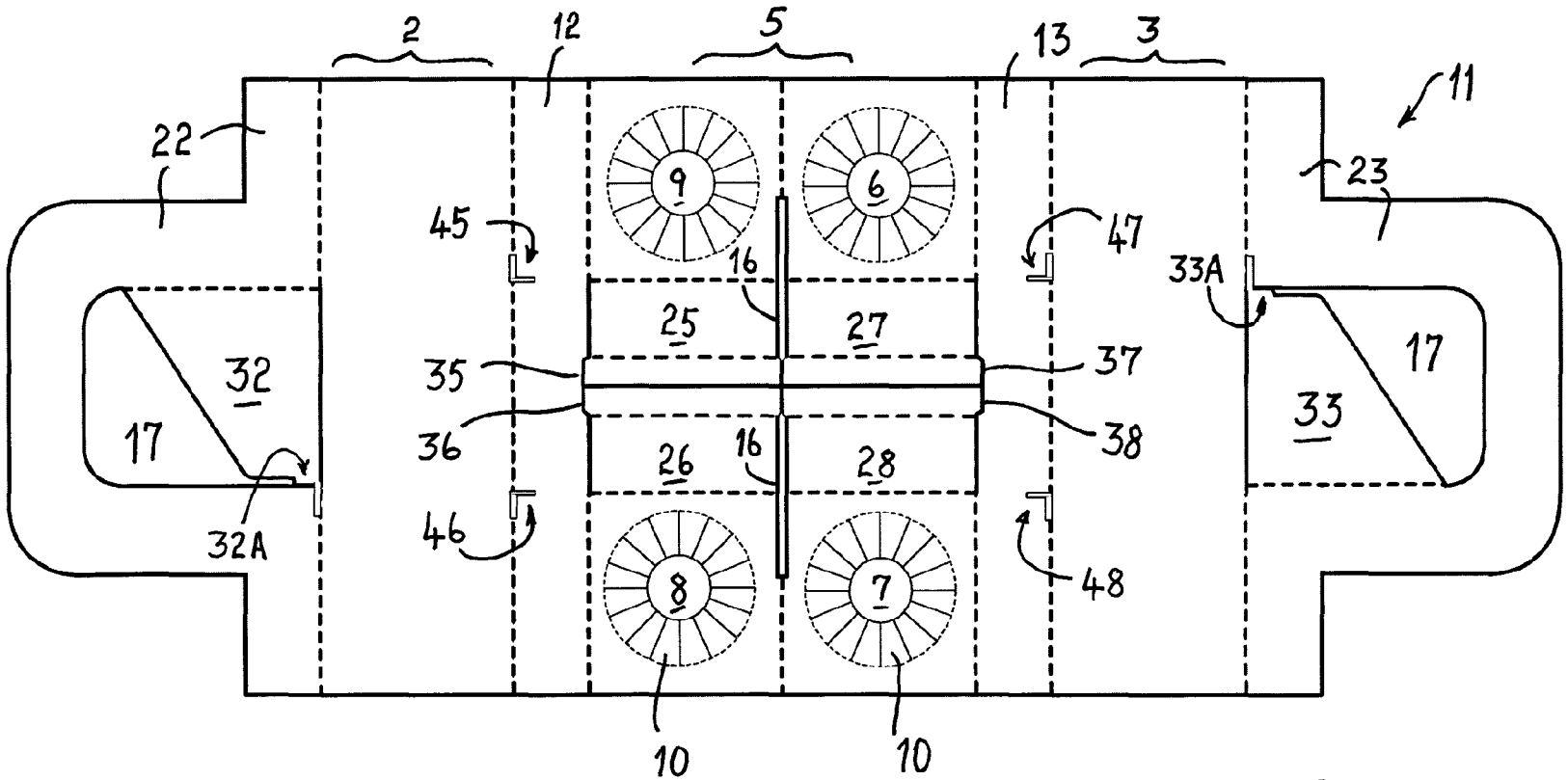
FIG. 6 is a plan view of the blank from which the container of FIG. 1 is assembled.
FIG. 7 is a side view of the blank of FIG. 6.
Figure 9:
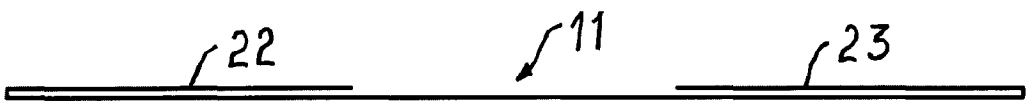
FIG. 9 is a side view of the blank folded as in FIG. 8.
Figure 8:
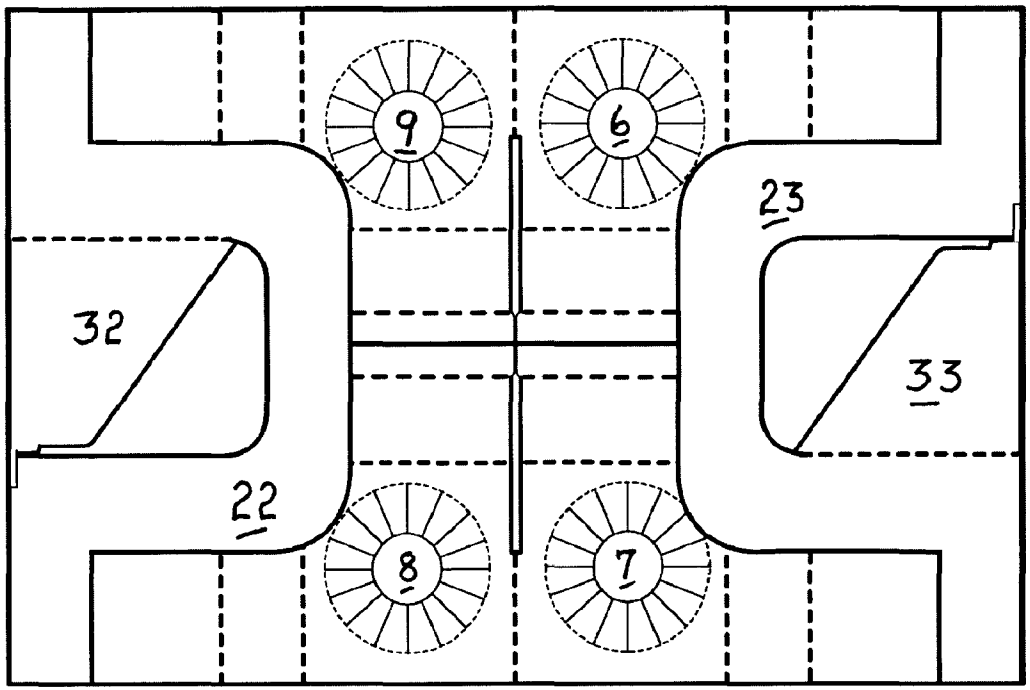
FIG. 8 is a plan view of the blank of FIG. 6 showing the first step in folding same into a transport configuration.

Turning now to FIGS. 6 and 7, the blank 11 (from which the carrier tray 1 is created by folding) is illustrated in FIG. 6 with cuts being illustrated by a solid line, and creases or folds about which portions are to be folded or bent being illustrated by a broken line. The blank 11 is fabricated from a single sheet of cardboard or similar sheet material is best seen in FIG. 7 where the blank 11 is seen in side elevation as being planar and of negligible thickness.

In order to convert the blank 11 into the carrier tray 1, first the handle portions 22 and 23 are folded downwardly into the plane of the page as seen in FIG. 6 so as to be substantially perpendicular to the corresponding base portions 2 and 3. Then the base portions 2 and 3 are folded downwardly into the page as seen in FIG. 6 so as to be substantially perpendicular to the side walls 12 and 13 respectively. Next the side walls 12 and 13 are bent downwardly into the page as seen in FIG. 6 so as to be substantially perpendicular to the upper deck 5. At the same time, the adjacent upper edges of the handle portions 22, 23 are passed into the handle receiving slot 16 of the upper deck 5. This is facilitated if the upper deck 5 is bent into a V-shaped configuration with the handle receiving slot 16 forming a ridge which is raised relative to the plane of the paper of FIG. 6. After this manoeuvre has been completed, the handle portions 22 and 23 abut each other, are vertical and pass though the handle receiving slot 16. In addition, the two base portions 2 and 3 are horizontal and the side walls 12 and 13 are vertical. This is the basic assembled configuration illustrated in FIGS. 1 and 5.

Next the central opening 18 is enlarged by folding downwardly each of the fold down walls 25-28 until the corresponding tongues 35-38 are latched into and retained by the base of the corresponding slots 45-48. Once this has been completed, the braces 32, 33 are able to be swung towards their adjacent corresponding side walls 12, 13 so as to enlarge the finger receiving opening 17 from the small size illustrated in FIG. 6 to the enlarged size illustrated in FIG. 2. Each brace 32, 33 has a small tongue 32A, 33A respectively which engages with the corresponding upstanding portion of the L-shaped slots 45-48.

In this configuration the carrier tray 1 is able to accommodate four coffee cups, or the like, one in each of the four container receiving apertures 6-9. In addition, the enlarged central opening 18 is able to accommodate miscellaneous items such as drinking straws, a personal wallet, edible substances such as candy bars, finger buns, pastries, and so on.

Turning now to FIGS. 8-11, it will be seen that the blank 11 in the configuration illustrated in FIG. 6 can be folded so that the handle portions 22, 23 are folded relative to the base portions 2, 3 upwardly out of the page of FIG. 6 until the handle portions 22, 23 substantially abut the remainder of the blank 11. This is the situation illustrated in FIGS. 8 and 9.

Figure 11:
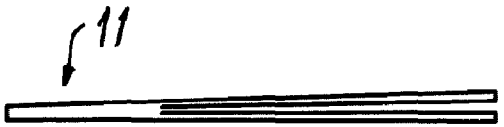
FIG. 11 is a side elevation of the blank folded as in FIG. 10.
Figure 10:
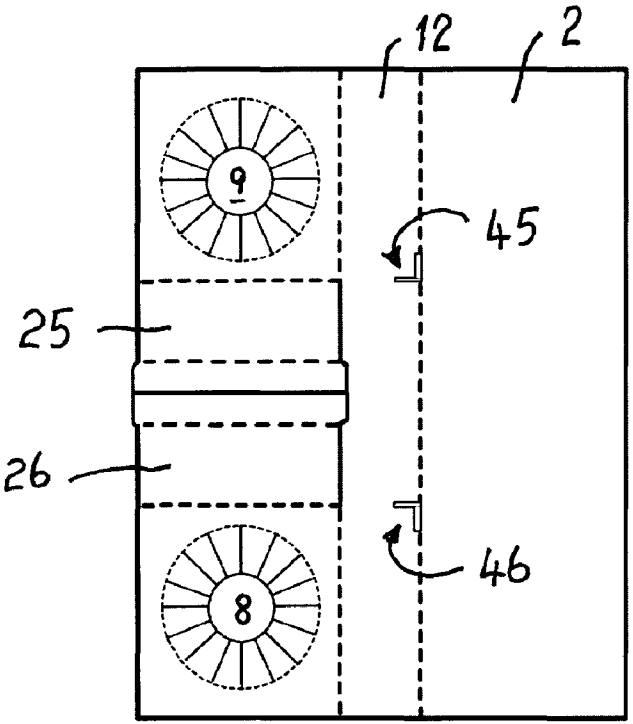
FIG. 10 is a plan view of the blank of FIGS. 6 and 8 folded into the transport configuration.

This process is continued by folding the upper deck 5 about the handle receiving slot 16 so as to abut the handle portions 22 and 23 and place the blank 11 into the configurations seen in FIGS. 10 and 11 which is a compact transport configuration.

Clearly, to convert from the transport configuration to the open configuration required prior to assembly and as illustrated in FIG. 6, the abovementioned procedure is reversed.

The above described embodiment has many advantages. Firstly, the blank 11 is able to be fabricated inexpensively and the carrier tray 1 is able to be created therefrom without any gluing or other manufacturing steps. The blank 11 can contain advertising and is easily fabricated from a grade of cardboard so as to be sufficiently strong to carry the appreciable weight of four drinks and miscellaneous items, edible or otherwise, within the central opening 18.

Furthermore, the carrying handle 15 is extremely convenient and enables the entire load to be carried in a single hand with the fingers passing through the finger receiving opening 17. The handle 15 is strengthened by the braces 32, 33 and these also provide a sufficiently sturdy arrangement to enable unbalanced loads to be carried.

To summarize, there is disclosed a carrier tray for cups, beverage bottles, and like containers for liquids, the tray being folded from a substantially planar blank and comprising a base, an upper deck spaced from the base and including at least one container receiving aperture, side walls extending between the base and upper deck, and a carrying handle extending above the upper deck.

Preferably the carrying handle is formed from two abutting and like shaped portions of the blank.

Preferably the base is formed from two spaced apart portions and the carrying handle portions are interposed between the base portions and extend through a handle receiving slot in the upper deck.

Preferably the side walls comprise a pair of walls each of which joins the upper deck to a corresponding one of the base portions.

Preferably the carrying handle has a finger receiving opening formed by a swing out brace portion which abuts one of the base portions.

Preferably each handle portion has a corresponding swing out brace portion.

Preferably the upper deck includes a plurality of the container receiving apertures arranged symmetrically relative to the carrying handle, and the upper deck further includes a central opening within which the swing out brace(s) pivot.

Preferably the upper deck central opening includes a plurality of fold down walls which extend to the base.

There is also disclosed a planar blank for a carrier tray for cups, beverage bottles and like containers for liquids, the blank comprising:

(i) a rectangular centrally located upper deck portion including a handle receiving slot and at least one container receiving aperture, (ii) a pair of side walls located one to either side of the upper deck portion, and foldable relative thereto, (iii) a pair of base portions located one adjacent to a corresponding one of the side walls, and foldable relative thereto, and (iv) a pair of handle portions located one adjacent to a corresponding one of the base portions, and foldable relative thereto, whereby the blank extending from one extremity to the opposite extremity comprises, in order, handle portion, base portion, side wall, upper deck portion, side wall, base portion and handle portion.

Preferably the upper deck portion includes a central opening having four fold down walls.

Preferably the central opening is substantially rectangular and has a longitudinal axis which is substantially perpendicular to the handle receiving slot.

Preferably the upper deck portion includes four of the container receiving apertures each of which has a plurality of radially extending fingers.

Preferably each of the handle portions is generally U-shaped and has a generally triangular swing out brace.

In addition there is disclosed a method of folding the planar blank above to form above the carrier tray, the method comprising the steps of:

(i) folding each of the handle portions to be substantially perpendicular to the adjacent base portion, (ii) folding each of the base portions to be substantially perpendicular to the adjacent side wall, (iii) folding each of the side walls to be substantially perpendicular to the upper deck portion whilst inserting both the handle portions into, and through, the handle receiving slot until the base portions are substantially parallel to the upper deck.

Preferably the method includes the further step of:

(iv) if the central aperture is provided with fold down walls, folding the fold down walls towards the base to abut same.

Preferably the method includes the further step of:

(v) if the handle portions are provided with the swing out braces, swinging the braces outwardly from the handle portions to thereby brace the carrying handle and open the finger receiving opening thereof.

Still further there is also disclosed a method of folding the above planar blank into a folded transport configuration, the method comprising the steps of:

(i) folding each the handle portion to lie substantially parallel to, and substantially abut, the adjacent base portion, and (ii) folding the upper deck portion about the handle receiving slot to substantially abut the folded handle portions.

Similarly, there is also disclosed a method of unfolding the above planar blank from a folded transport configuration to a planar assembly configuration, the method comprising the steps of:

reversing steps (ii) and (i) in that order of the last mentioned method.

The foregoing describes only one embodiment of the present invention and modifications, obvious to those skilled in the cardboard folding arts, can be made thereto without departing from the scope of the present invention. For example, the L shaped slots 45 and 48 can be provided as a pair of spaced apart slots one vertical and one horizontal in the assembled tray.

The term "comprising" (and its grammatical variations) as used herein is used in the inclusive sense of "including" or "having" and not in the exclusive sense of "consisting only of".

The invention claimed is:

1. A carrier tray for a container of liquid, said tray being folded from a substantially planar blank and comprising:

a base;

an upper deck spaced from said base and including at least one container receiving aperture;

side walls extending between said base and upper deck; and a carrying handle extending above said upper deck and formed from two abutting and like shaped handle portions of said blank, wherein said base is formed from two spaced-apart base portions that are spaced apart and said carrying handle portions are interposed between said base portions and extend through a handle receiving slot in said upper deck, wherein said side walls comprise a pair of walls that each joins said upper deck to a corresponding one of said base portions, and wherein said carrying handle has a finger receiving opening formed by a swing out brace portion which abuts one of said base portions.

2. The carrier tray as claimed in claim 1 wherein each handle portion has a corresponding swing out brace portion.

3. The carrier tray as claimed in claim 1 wherein said upper deck includes a plurality of container receiving apertures arranged symmetrically relative to said carrying handle, and said upper deck further includes a central opening within which said swing out brace portion pivots.

4. The carrier tray as claimed in claim 3 wherein said upper deck central opening includes a plurality of fold down walls which extend to said base.

5. A planar blank for a carrier tray for a container of liquid, said blank comprising:

a rectangular centrally located upper deck portion including a handle receiving slot and at least one container receiving aperture;

a pair of side walls, each side wall located to either side of said upper deck portion, and foldable relative thereto;

a pair of base portions, each base portion located adjacent to a corresponding one of said side walls, and foldable relative thereto; and a pair of handle portions, each handle portion located adjacent to a corresponding one of said base portions, and foldable relative thereto, wherein said blank extending from one extremity to the opposite extremity comprises, in order, one of said handle portions, one of said base portions, one of said side walls, upper deck portion, the other of said side walls, the other of said base portions, and the other of said handle portions, and wherein said upper deck portion includes a central opening having four fold down walls.

6. The blank as claimed in claim 5 wherein said central opening is substantially rectangular and has a longitudinal axis which is substantially perpendicular to said handle receiving slot.

7. The blank as claimed in claim 5 wherein said upper deck portion includes four container receiving apertures, each container receiving aperture having a plurality of radially extending fingers.

8. The blank as claimed in claim 5 wherein each of said handle portions is generally U-shaped and has a generally triangular swing out brace.

* * * * *